United States Patent [19]

Lees

[11] 4,297,039

[45] Oct. 27, 1981

Best Available Copy

[54] THERMAL PRINTER

[75] Inventor: Robert Lees, Newark, Del.

[73] Assignee: Autotote, Ltd., Newark, Del.

[21] Appl. No.: 974,440

[22] Filed: Dec. 29, 1978

[51] Int. Cl.[3] ..... B41J 3/20

[52] U.S. Cl. ..... 400/120; 400/48; 400/58; 400/621; 400/619; 400/701; 400/708; 346/76 PH

[58] Field of Search ..... 400/48, 58, 619, 120, 400/621, 680, 683, 684, 701, 702, 702.1, 708, 708.1; 346/76 R, 76 PH, 76 L; 219/216

[56] References Cited

U.S. PATENT DOCUMENTS

| | | | |
|---|---|---|---|
| 3,845,850 | 11/1974 | Herr et al. | 400/120 |
| 3,855,448 | 12/1974 | Hanagata et al. | 346/76 PH X |
| 3,905,462 | 9/1975 | Nowak | 346/76 PH X |
| 3,916,420 | 10/1975 | Brown et al. | 346/76 PH X |
| 3,960,080 | 6/1976 | Adahan | 400/621 X |
| 3,967,092 | 6/1976 | Conta et al. | 346/76 PH X |
| 3,987,882 | 10/1976 | Kobryn | 400/120 |
| 4,000,393 | 12/1976 | Cochran et al. | 400/120 X |
| 4,011,811 | 3/1977 | Kodis | 400/621 X |
| 4,030,587 | 6/1977 | Walker | 400/120 X |
| 4,030,588 | 6/1977 | Hanagata et al. | 400/120 |
| 4,039,065 | 8/1977 | Seki et al. | 400/120 |
| 4,120,245 | 10/1978 | Karp et al. | 400/48 X |

FOREIGN PATENT DOCUMENTS

| | | | |
|---|---|---|---|
| 2137644 | 3/1973 | Fed. Rep. of Germany | 400/701 |
| 1090636 | 10/1954 | France | 400/708 |
| 1435950 | 5/1976 | United Kingdom | 400/120 |

*Primary Examiner*—Ernest T. Wright, Jr.
*Attorney, Agent, or Firm*—John C. Dorfman

[57] ABSTRACT

A thermal printer provides first and second sub-frames pivotally supported on a main frame to provide access to a dot resistance heater for cleaning and easy removal of the respective structures. Each structure is releasably fixed in operating position in which a resilient drive roller on the second sub-frame presses the thermally sensitive paper against the printer head. The same roller is driven by a motor on the second sub-frame and moves the paper along the paper path by friction drive. The paper moves between a fixed and rotatable knife on the second sub-frame actuated by crank and linkage connection to the core of a solenoid whose winding is fixed on the main frame. A curved guide plate directs the paper toward an opening and into a surface which imposes an S curve on the paper. The S curve allows enlargement of a storage loop in the paper in case the opening is blocked.

6 Claims, 7 Drawing Figures

THERMAL PRINTER

The present invention relates to a thermal printer for the rapid production of tickets, or the like. It particularly has relation to an advantageous configuration of the printer which facilitates cleaning, efficient drive and feed of continuous stock through the printer, efficient cut-off of the continuous paper tape and prevention of jamming of the cut-off mechanism.

There has been a need for devices to quickly and accurately produce tickets or receipts in situations where the printer output needs to be rapidly generated but also must be arranged and formated so that the printed product cannot be easily counterfeited. One application of such printers is in the printing of tickets where the print-out is not sequential or otherwise predetermined but some original data input is required. Such an application is the printing of betting tickets, either at a race track or in an off-track situation. Another application is lottery tickets. The printer finds considerable advantage where the ticket contains variable data, preferably in fixed format, but which must be adjusted in some respect in a custom fashion, as when it must contain variables selected on the spot by a bettor, and the ticket must be rapidly generated.

Thermal printers have been designed in the past for printing such tickets on thermally sensitive paper. Such printers include line printers and matrix printers which provide dot resistance elements in at least a row across the path of the tape which can be selectively heated to generate numbers, letters, or other characters or marks incrementally. The present invention relates to a thermal printer having mechanical features or associated structural improvements making such a printer more useful and more acceptable in the environment in which it is commonly used.

A common problem with thermal printers, because the papers employed are chemically coated to accept heat induced marking, is that the printer head or surface of the resistance elements over which the coated paper moves becomes covered with paper particles and chemical debris which interfere with its efficient operation. Various techniques have been suggested for enabling cleaning of the printer head or element.

The present invention provides a very simple means whereby the printer head is supported on a sub-frame structure which is able to be pivoted out of its operational position to a cleaning position in which the thermal print elements are exposed and can be easily wiped or otherwise cleaned by techniques prescribed by the particular manufacturer in each given case. In particular, the present invention relates to providing such a printer head on a support platform which extends beyond the region of the printing element or head. The platform is supported on a sub-frame which, in turn, is rotatably supported to rotate about pivot means on the frame. Such rotation enables the printer head to be rotated away from its operational position to an alternative cleaning position when releasable means holding it to the frame in operational position are removed. Preferably, the pivot means is an axle or aligned pins on the frame. The support platform is removable from the sub-frame. The support frame has a support member which snugly engages but does not surround the pin or other coaxial member. Because the support member is provided only on the side of the pin toward the work surface, the support platform which rests on another structure of the sub-frame at its opposite end may be removed from the sub-frame, or the like, if desirable or necessary for repair or replacement of the printing elements, for example.

Another aspect of such printers which has caused a problem in printers of the prior art has been the drive. The present invention provides an extremely simply drive in the form of a driven resilient roller which, in effect, urges the continuous coated tape into good printing contact against the print elements by direct pressure. This resilient roller is also a friction element which drives the tape, which advantageously has a lower coefficient of friction on the coated or treated surface and a higher coefficient of friction on the opposed surface against which the resilient roller bears. Since the drive is so simple, it allows the roller itself to be driven by a very lightweight motor directly or through simple gearing. Preferably, the driven roller and its driving motor are supported on a second common sub-frame, separate from the sub-frame of the printer elements. In accordance with the present invention, it is preferred to provide a second sub-frame for supporting the roller and the motor, as well as cut-off means to cut the tape to form a ticket of desired length. Also, in accordance with the present invention, this second sub-frame is preferably pivotally supported on the main frame in a manner similar to the support of the printer supporter sub-frame by means which permits pivoting out of the operational position to an alternative position from which easy removal for work on or replacement of the parts of the sub-frame is faciliated.

A further aspect of the present invention has to do with the cut-off means which is also advantageously included on the second sub-frame. In accordance with preferred embodiments of the present invention, the cut-off device is a rotary knife which operates in combination with a fixed knife. The rotary knife has an axis of rotation parallel to the friction drive roll and preferably permits the paper tape to pass between the rotatable cut-off knife and the fixed knife, both of which are preferably provided on the sub-frame.

The present invention also provides guide means on the sub-frame for guiding the tape up toward an access slot or opening in a printer housing or cover through which tickets which have been printed and cut off may be removed. This opening ordinarily constitutes a slot through which the ticket may pass, and it is a common problem that the person taking the ticket, whether he be the customer or a machine operator, may sometimes block the opening. When this is done, the tendency is for tickets to pile up and jam the cutter so that the machine will fail to function properly.

In accordance with the present invention, however, the frame is located in its operating position such that paper tape is guided toward an opening along a curved path. This curved paper path strikes a deflection surface adjacent the opening. The paper path is changed by the deflection surface into an S-shaped path such that pressure against the paper end will cause its S form to flex and resiliently yield, enlarging at least one loop of the S as a storage loop as it continues to be fed through the printer until it is cut off. Therefore, an individual tickeet which is held within the printer by closing the opening will be retained and accommodated by assuming the S shape. Then, due to its inherent resiliency, when the opening is released, the ticket will release the energy stored in the enlarged loop and cause the end of the ticket to pop out of the opening and be readily removable. The configuration also permits a pile or conforming stacking of the tickets so that even if the hold up is prolonged, within reasonable limitation, several tickets can be printed out and cut off and assume a conforming S curvature in the stack without jamming the machine.

For a better understanding of the present invention, reference is made to the accompanying drawing in which.

Figure 1:
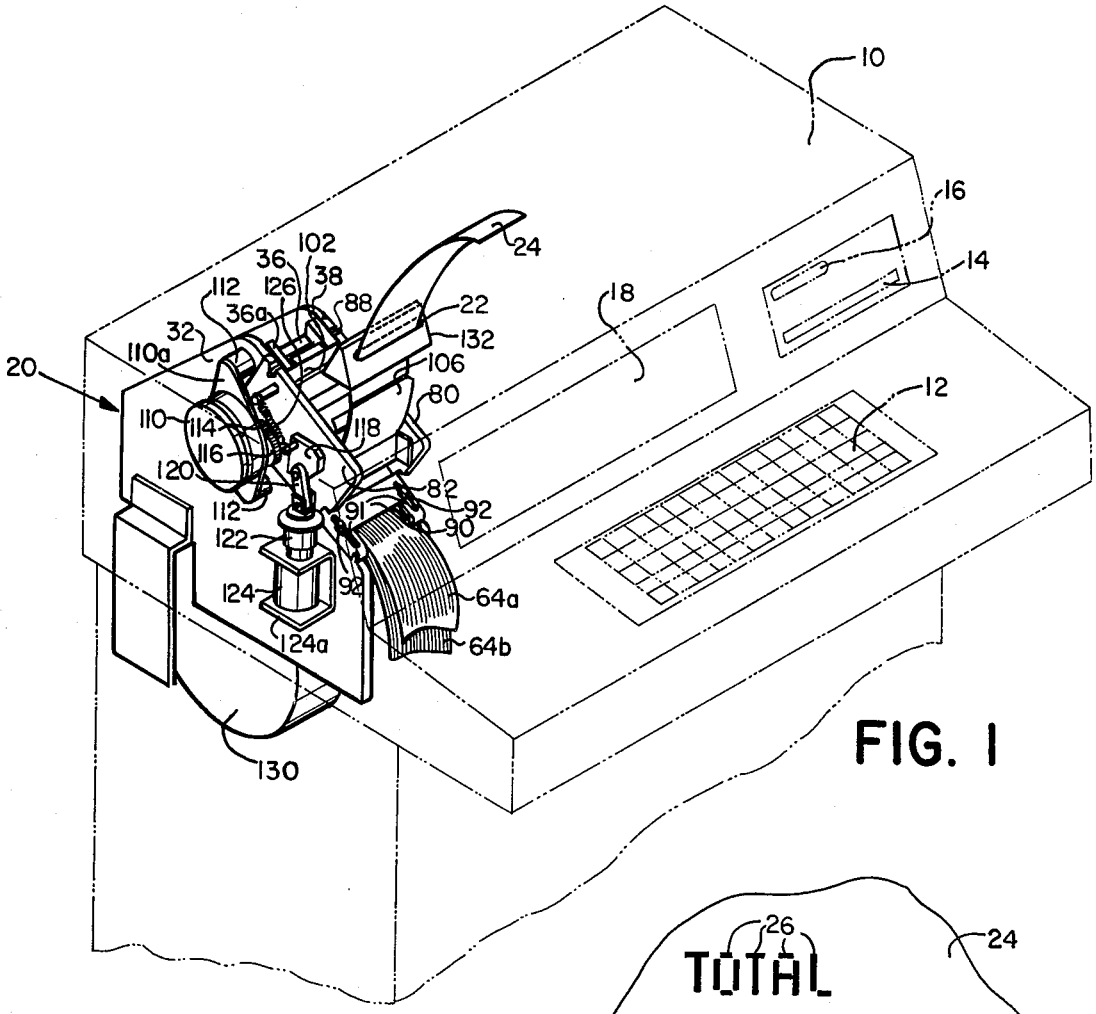
FIG. 1 is an isometric view of a computer terminal, for example, of the type used in processing bets, incorporating a printer of the present invention and having an output slot in its cover for removal of printed tickets, the cabinet and terminal ports being shown in phantom, except for the printer.

Referring now to FIG. 1, the structure in phantom represents a terminal of a typical machine which might be used either for paramutual betting or lottery type betting. The terminal has a cover generally designated 10 which encloses various elements which may include many computer elements, logic and system programming elements and other system elements designed to receive the input from a keyboard 12. The terminal may be designed to receive other input, for example, punched cards. An input slot 14 is designed to received marked cards of the IBM type, for example, containing data to be stored in the minicomputer, or transmitted to a central processor as needed. A suitable card reader is employed within the terminal and is connected with the computer and logic. Other types of input can additionally or alternatively be used in other devices of similar type. A ticket input slot 16 provides access to means for receiving and driving the ticket through the terminal mechanism and back out. The purpose of its operation is to permit reading of the ticket and therefore the device includes at least an optical mark reader to read visible marks printed on the ticket and means to feed the data thus collected through logic to the computer. The reader and associated circuits may include other devices for safety and security to recognize a valid ticket and reject others.

A window 18 provides a view of a device which displays information input into or generated in the terminal, in some acceptable and standard format. The display might, for example, be LED, liquid crystal, or, in some cases, CRT type displays, or other displays suitable for the purpose.

In a betting situation, the printer 20 is provided within the cover 10 of the terminal device in position to print and issue tickets through a ticket output slot 22. The printer 20 is held in position relative to the ticket output slot 22 and functions in cooperation with the structure of that slot 22 as will be explained hereafter.

Figure 2:
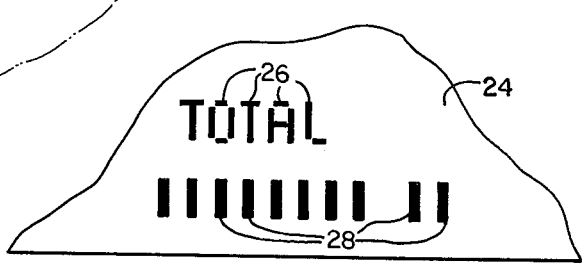
FIG. 2 is a partial view of an area of a ticket printed by the printer, showing the style of printing involved.
Figure 6:
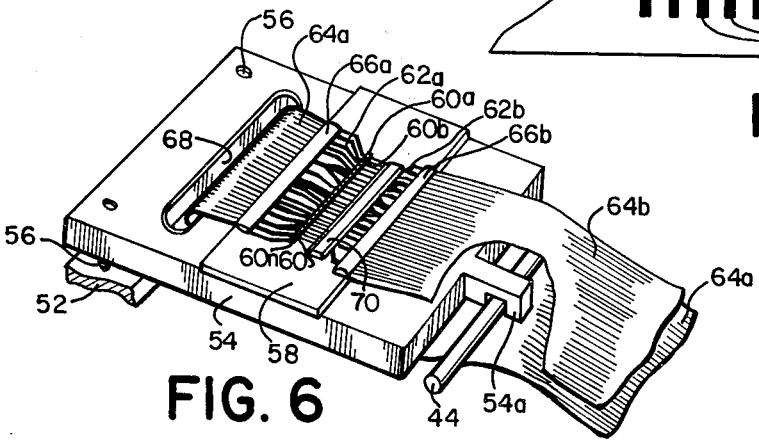
FIG. 6 is a perspective view of the printing element of the printer.

Referring now to FIG. 2, it will be seen that letter 26 or numbers or other marks 28 printed by the printer 20 are of a type wherein resistance heated thermal dot elements, which may be square, round, or other suitable shape provide incremental printing elements, which by known controls and logic, may be programmed to print on heat sensitized paper 24. Preferably, the sensitized surface of the paper 24 is in contact with the dot elements to accomplish this printing or, at least, it is very close spaced to it. As seen in FIG. 1 sensitized paper 24 is provided in a continuous roll 130 of proper width for tickets and fed through the printer 20 in such a way that it is held in contact with the thermal printing dots 60*a*, 60*b*, . . . 60*n* in the course of printing. As will be explained hereafter in connection with FIG. 6, the dots 60*a*, 60*b*, . . . 60*n* are arranged in at least one row array 60 across the width of the paper 24 as seen in FIG. 6 and may be arranged in a plurality of rows to provide a matrix. In the event a single row array 60 is used, the procedure is to program the heating of the dots 60*a*, 60*b*, . . . 60*n* in such a way that whenever a character is to be printed, the dots 60*a*, 60*b*, . . . 60*n* are heated at an appropriate location across the moving paper 24 to provide an increment of each of the letters 26 being printed. Successive rows of increments are printed to provide complete letters 26, numbers or symbols 28 as the paper 24 is moved passed the printer 20. In contrast, where a matrix is used, a whole or at least a substantial part of the characters or codes may be printed at the same time by the matrix of dots selectively heated ones of which form the mirror image of the desired pattern to be printed at the same time across the ticket paper 24. FIG. 2 shows just a small portion of a ticket printed in this fashion whereby the results of incremental printing of the dots 60*a*, 60*b*, . . . 60*n* may be recognized. FIG. 2 shows the coated side of the paper 24 whose thermally sensitive materials have responded to heating to produce dark dots in patterns. This thermally sensitive coating is placed against the thermal printer element in the printing process. In this particular instance, letters 26 have been printed and code bars 28 have also been printed. Numbers, numerals, letters 26 and other types of coding 28 may be printed equally well using a printer 20 of this type. The patterns printed are all within the function of the input logic, memory and programming of the computer to energize the resistive dots 60*a*, 60*b*, . . . 60*n* of the printer 20 in the proper sequence.

Figure 3:
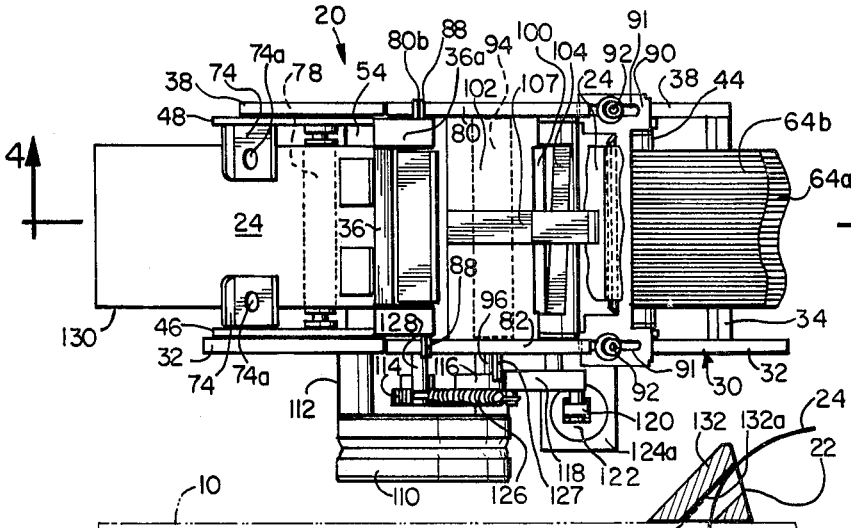
FIG. 3 is an enlarged plan view from above of the printer of the present invention.

Referring now to FIG. 3, a plan view of the printer 20 from above is shown. It will be observed in this view that the printer 20 is assembled on a main printer frame 30, which, in turn, is fixed to the overall terminal structure and particularly has a fixed orientation relative to the cover 10 and the ticket output slot 22. The main printer frame 30 includes a sidewall 32 serving also as a mounting bracket and circuit support member. The printer 20 may be supported on the support frame of the terminal by bolting the wall 32 to an appropriate structure within the terminal. The working part of the structure is supported on the fixed position frame 30 which includes parallel sidewalls 32 and 38 connected together by cross-bracing members 34 and 36, and such other structure as may be required. A sub-assembly including a printer base element 54 is supported between walls 32 and 38 on a pivot pin or axle 44. This printer support sub-frame includes walls 46 and 48 parallel to frame walls 32 and 38 and crossbraces 50 and 52. This sub-frame is supported at one end on the pivot pin 44 which permits the sub-frame to rotate relative to and within the close spaced frame members 32 and 38 from the operational position shown in FIG. 4 to an alternative position shown in FIG. 5 wherein the printing elements are accessible for cleaning.

The printer assembly shown in FIG. 6 is removably supported on this sub-frame structure on the axle 44 and the cross-brace 52. It consists of a metallic base element 54 with at least one support key member 54*a* having a downward facing channel to rest atop and snugly receive axle 44. The position of the printing head relative to the movable sub-frame is provided with Vlier set screws 56 on opposite sides of the base element 54 at the end opposite key member 54*a*. The set screws 56 adjust the position of the printer base element 54 relative to sub-frame cross-brace 52 which gives some range of adjustment to the printer base element 54 relative to the paper path. The printer base element 54 is advantageously of cast metal which doubles as a heat sink and provides a shallow transverse channel to support a printed circuit board 58 or other type substrate of suitable insulating, heat resistant material which is capable of being used as a printed circuit board. Substrate 58 carries a line or row array 60 of dots 60*a*, 60*b*, . . . 60*n*, whose internal resistance enables them to be used as incremental resistance heating elements to accomplish printing on the thermally sensitive paper 24 which passes over them, and preferably in contact with them or close enough to be affected by the heat generated by energized dots 60*a*, 60*b*, . . . 60*n*. The individual dots 60*a*, 60*b*, . . . 60*n* are connected with individual conductors 62*a* and 62*b* comprising part of the printed circuitry on the printed circuit board 58. As many conductors 62*a* as there are dots 60*a*, 60*b*, . . . 60*n* in a line array 60 connected to one side of the individual dots 60*a*, 60*b*, . . . 60*n* and a corresponding number of conductors 62*b* are connected to the other side. Each of these printed conductors 62*a*, 62*b* provides a separate connection to each of the separate wire conductors in the belt cables 64*a* and 64*b*, respectively. The individual conductors of the cables 64*a* and 64*b* are conductively connected to the printedcircuit board conductors 62*a* and 62*b*, respectively, and then covered by suitable insulating material 66*a* and 66*b*, such as epoxy resins, which protect and reinforce the fragile connections. A slot 68 through base element 54 permits belt cable 64*a* to pass through and beneath the base element 54. A paper deflector guide 70 is provided on the board 58 close spaced to the dots 60*a*, 60*b*, . . . 60*n* to cause the paper path to be deflected upwardly after passing over the individual resistance dots 60*a*, 60*b*, . . . 60*n* of line array 60.

Figure 4:
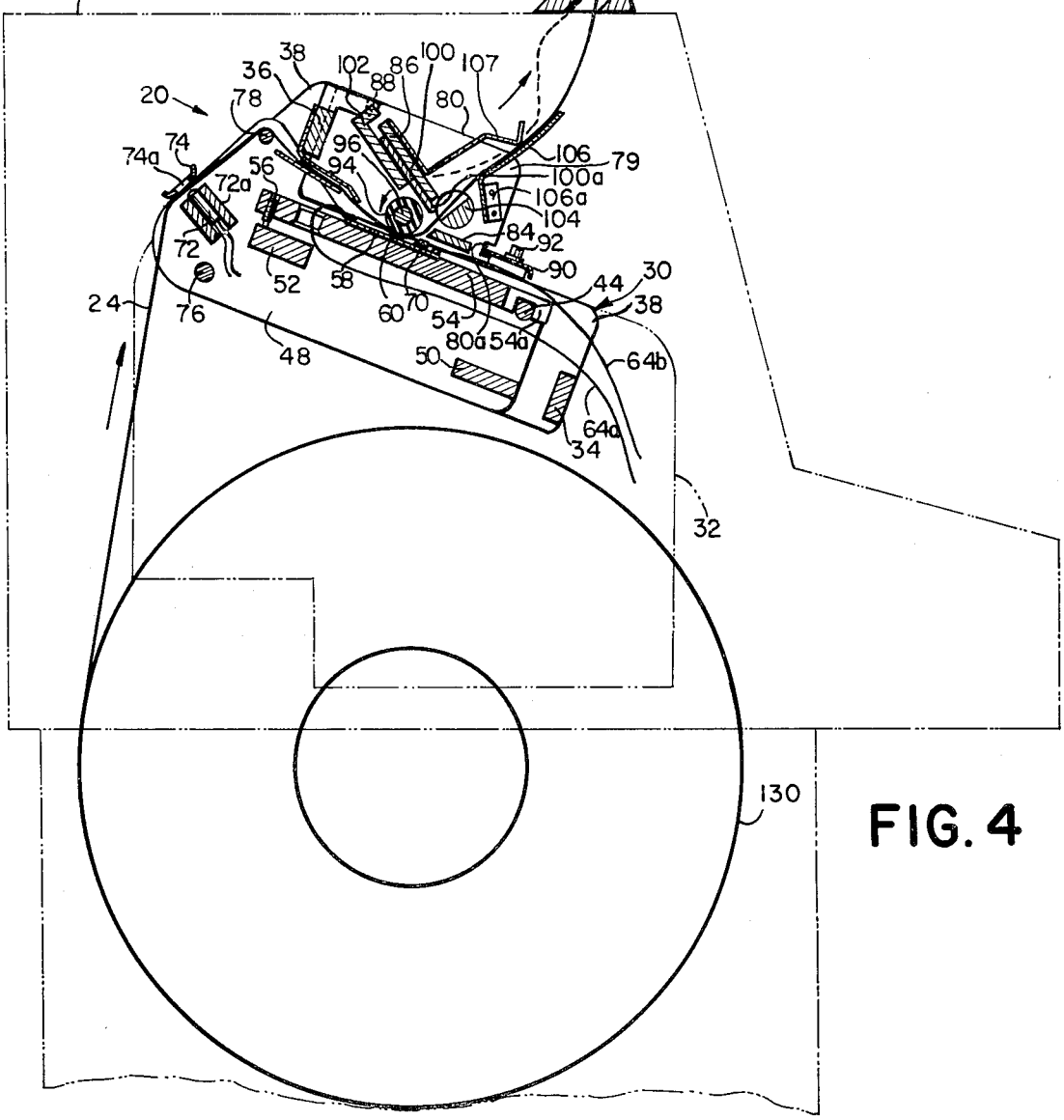
FIG. 4 is a slightly reduced sectional view taken along line 4—4 of FIG. 3 and showing the terminal cover in phantom except for the ticket output slot.

The walls 46 and 48 of the movable sub-frame as seen in FIG. 4 each also carry a photodetector 72 supported by suitable bracket 72*a* along the paper path. The sidewalls 46 and 48 also support guides 74 provided with holes 74*a* which permit light to pass to the photodetectors 72 in the event that paper 24 does not intervene. In this way, the end of the roll of paper 24 is detected. The photodetectors 72 may also preferably provide an interlock switch (not shown) to stop the paper drive and shut down printer operation until a new roll of paper 24 is supplied. The printer sub-frame walls 46 and 48 are held in position relative to main frame walls 32 and 38 by a releasable means such as knurled thumb screws 76 which pass through walls 46 and 48 and engage in holes in walls 32 and 38 to support the printer sub-frame in its normal operating position shown in FIG. 4. Screws 76 are removable from walls 32 and 38 to allow the structure to rotate about axle 44 down into the alternate position shown in FIG. 5 for cleaning, or alternatively for removal of the base element 54 of FIG. 6 for replacement of parts or checking. The ease in cleaning and replacement of the printer structure is an advantage of the present invention, as previously mentioned.

Figure 5:
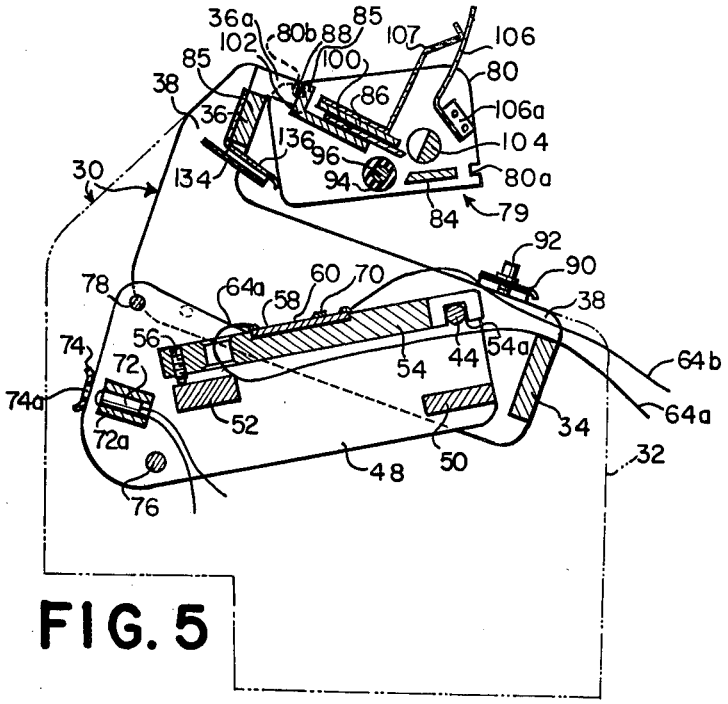
FIG. 5 is a view similar to FIG. 4 showing the printer in alternative, non-operational, position.

In similar fashion, the drive and cut-off assemblies of the printer 20 are mounted on a second sub-frame 79 pivotally supported from the main frame 30. The second sub-frame 79 consists of parallel walls 80 and 82 (of the same spacing as main frame walls 32 and 38) interconnected by cross members 84 and 85 and fixed knife support member 86. Main frame cross member 36 is provided with extension arms 36*a* which support roll pins 88 protruding from each side wall 80, 82. Arms 36*a* extend within main frame sidewalls 32 and 38. The pins 88 are engageable in slots in the second sub-frame walls 80 and 82, of which slot 80*b*, shown in FIG. 5, is representative. The slots, such as 80*b*, are of such form as to enable the sub-assembly to be manually raised about its pivot into the alternate position shown in FIG. 5 from the operation position shown in FIG. 4, and further allow the whole assembly to be removed from the position of FIG. 5 by raising the sub-frame 79 until the pins 88 clear the slots, e.g., slot 80*b*. The slide member 90, best seen in FIG. 1, is provided with slots 91 through which holding screws 92 engage the tops of the frame walls 32 and 38. Slide member 90, in its uppermost position, will engage slots, such as slot 80*a* (see FIG. 4) to hold the second sub-frame 79 in operating position relative to the main frame 30. In this position, the screws 92 are tightened and hold slide member 90 in place. By loosening the screws 92 and sliding slide member 90 downwardly and away from walls 80 and 82 the second sub-frame 79 may be moved from the position shown in FIG. 4 to the position shown in FIG. 5 and then totally removed from the main frame 30, if desired.

The second sub-frame 79 supports the resilient roller 94. Roller shaft 96 is supported between and extends through and is rotatably supported by the sidewalls 80 and 82, as will be further explained. The roller 94 is parallel to and positioned opposed to the line array 60 of incremental thermal printing dots 60*a*, 60*b*, . . . 60*n* and positioned to provide a required pressure to urge the paper 24 onto the dots 60*a*, 60*b*, . . . 60*n*. The adjustment of screws 56 effectively allows some relaxation or increase in the pressures applied.

As mentioned, in connection with FIG. 6, the element 70 acts to deflect the paper 24 upward. Thereafter, as seen in FIG. 4 the edge of cross-bar 84 further continues the guiding effect to direct the paper 24 between rotary knife 104 and fixed knife 100. Fixed knife 100 is adjustably supported between the plate member 102 and the knife support member 86. The rotary knife 104 is coordinated with the drive to cut off paper 24 to produce tickets of desired length. The paper 24 which passes between the knives 100, 104 is guided upwardly toward the ticket output slot 22 by curved guide 106. Guide 106 is supported on the walls 80 and 82 by flanges 106*a*. In practice, as seen in FIG. 4, slot 22 is not a simple slot but is formed of a triangular cross-sectioned member 132 whose upper wall 132*a* provides a deflecting surface diverting the ticket from the curved path produced by guide 106 into a reverse curve before the paper 24 leaves the output slot 22 so that the paper 24 assumes a somewhat S shaped form as seen in FIG. 4.

Paper 24 moves through the system by virtue of the frictional drive of roller 94 which is moved in proper direction to promote that drive by motor 110. Motor 110 is supported from frame wall 32 on posts 112 through flange 110*a*, as best seen in FIG. 1. The motor 110 carries on its shaft a pinion 114 which, in turn, drives gear 116 on the shaft 96 of roller 94 to provide the steady forward drive of the paper 24 when the motor 110 is energized. The motor 110 is, of course, energized and drives the paper 24 in accordance with the dictates of the terminal's programming.

Figure 7:
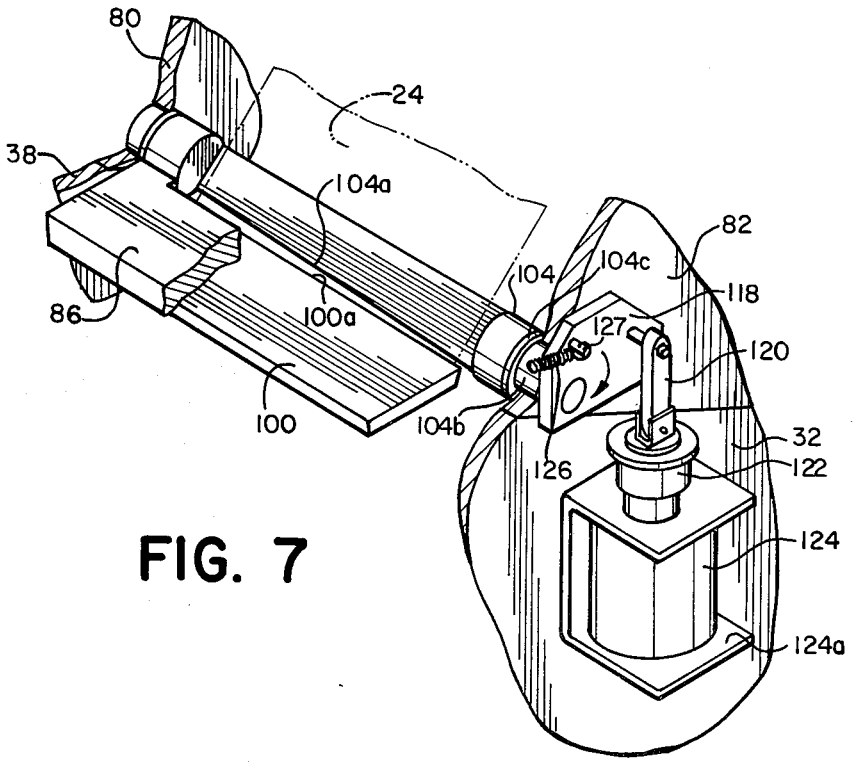
FIG. 7 is a perspective view of the cutter structure and actuator of the printer.

The rotary knife 104, as seen in FIG. 7, is supported between the sub-frame walls 80 and 82 in bearings 104*c* through which shaft portion 104*b* passes to be connected outside of wall 82 to crank lever 118. Lever 118, in turn, is connected to pivoted link 120, itself, is pivotally connected to core 122 of a solenoid. The winding 124 of the solenoid is supported by a bracket 124*a* on the main frame wall just below sub-frame wall 82. Energization of the solenoid will cause the core 122 to be drawn into the solenoid winding 124 pulling the crank lever 118 downward and rotating the rotatable knife 104 until its knife edge 104*a* engages the knife edge 100*a* of fixed knife 100 and cuts the paper 24. The cutting engagement occurs sequentially across the width of the paper 24, cutting the paper 24 like scissors. When the cutting is completed, the solenoid winding 124 is deenergized. Then, the core 122, link 120 and the crank lever 118 are returned to their initial position by spring 126 attached between post 128 on wall 82 and post 127 on lever 118 so that the paper 24 can continue to pass between the knives 100 and 104. Core 122 is loose enough to be easily separated from winding 124 as sub-frame wall 82 is raised into the position of FIG. 5.

As seen in FIG. 4, the paper 24 is supplied in a large roll 130 which is fed upwardly through paper guide 74 and over roller guide 78 between guide members 134 and 136 supported on cross bracing member 36 of the main frame 30. From this point, the paper 24 passes beneath roller 94 which squeezes it against the row of dots 60*a*, 60*b* . . . 60*n* and is then diverted up by the bevelled front surface of guide member 70. The edge of structural cross member 84 is also slightly bevelled to serve as a guide to direct the paper 24 between the rotary knife 104 and stationary knife 100. Thence, the paper 24 moves upwardly along the curved path defined by guide 106 held in place by spring finger 107. The paper 24 is finally diverted into its S shape by top wall 132*a* of guide 132 and passes out the slot 22. If someone puts his hand over the slot 22, the paper 24 will assume the storage position shown in dashed lines in FIG. 4 due to the curvature of guide 106 and deflection of surface 132*a* which forms an S-shaped bend in the paper 24 which can accommodate a larger storage loop as shown. In fact, once the paper 24 is cut off, the trailing cut ends of the tickets are moved by the rotation of knife 104 to the surface of support member 86 on which they will remain until withdrawn from the slot 22. The ticket will remain in this position until the slot 22 is freed, at which time its end will pop out of the slot 22 to be easily grabbed. At the same time the tickets held by support member 86 will not tend to back up through the knife. Furthermore, subsequent tickets can pile up beneath the first ticket and assume the same contour so that despite the fact that the machine continues to run while the slot 22 is blocked, no jam will result, at least for a certain period of time, during which as many as 9 or 10 tickets might be printed.

The present invention has been described in terms of its structure, and it will be understood by those skilled in the art to be capable of variation from the actual structure shown. While the embodiment shown is one which has been built and is preferred, many variations in the structure are possible and will occur to those skilled in the art. All such variations within the scope of the claims are intended to be within the scope and spirit of the present invention.

I claim:

1. A document printer for printing documents on thermally sensitive paper and driving said paper through cut-off means to cut the paper to predetermined lengths comprising:

a frame having generally parallel spaced apart walls;

a drive motor on the frame having drive engaging means for driving said thermally sensitive paper;

actuator means on the frame for actuating the cut-off means;

a first sub-frame having generally parallel spaced apart walls parallel to the walls of the frame, which first sub-frame is pivotally supported on and within the frame walls by first pivot means generally perpendicular to the parallel walls and has an operational position;

a thermal printing element on a separate removable base supported on the first sub-frame by a pivot pin engaging portion open on one side which enables the base in alternate position of the first sub-frame to be lifted away from the first sub-frame and supported at the opposite end by means which rests against the first sub-frame on the side opposite from a friction drive roller means, the thermal printing element being supported in position to define a portion of a paper path and comprising at least a row of high resistance printing dots;

a second sub-frame having generally parallel spaced apart walls parallel to the walls of the frame, which second sub-frame is pivotally supported on the frame by second pivot means generally perpendicular to the parallel walls and has an operational position adjacent and opposed to the operational position of the first sub-frame;

the friction drive roller means being rotatably supported on the second sub-frame opposite from the thermal printing element and positioned to drive the thermally sensitive paper along a path past the thermal printing element by contacting the paper on the side opposite from the thermal printing element, the friction drive roller means being positioned on the second sub-frame opposite the thermal printing element in such position as to urge through its inherent resiliency the paper to engage the thermal printing element so that the thermal printing element is effective to print on the paper and having drive coupling means positioned to engage the drive engaging means of the drive motor to move said thermally sensitive paper along the paper path past the thermal printing element when the second sub-frame is in operational position, the motor being supported on the frame, said drive coupling means comprising gear means and the gear means being rotatably supported on the second sub-frame so that the gear means are engaged on the second sub-frame in operational position and disengaged as the second sub-frame is moved from operational position;

the cut-off means being positioned on the second sub-frame to cut off the paper at selected lengths to include predetermined ticket information on the selected length and linkage means placed into actuating position with the actuator means when the second sub-frame is in operational position;

separate releasable means for normally maintaining each of the sub-frames in its operational position but permitting pivotal movement to at least an alternate position upon release of the releasable means, such that in the alternate positions the thermal printing element may be reached for cleaning; and means to selectively heat individual dots to generate patterns on said thermally sensitive paper moved past the thermal printing element.

2. The document printer of claim 1 in which the second sub-frame supporting the gear means and friction drive roller means is pivotally supported at one end on the frame and is releasably attached at its other end so that the second sub-frame may be pivotally moved to a position alternative to its operational position for examination without complete removal.

3. The document printer of claim 2 in which the pivotal support of the second sub-frame is made through said second pivot means on the second sub-frame engaged in slots in the frame which are directed away from the printer but which snugly engage a surface coaxial with the axis of rotation of the second sub-frame.

4. The document printer of claim 3 in which said actuator means for the cut-off means includes a solenoid which is fixed to the frame and said linkage means includes a removable iron core which is fixed to a linkage system attached to the cut-off means on the second sub-frame.

5. The document printer of claim 4 in which the cut off means includes a rotary knife on the second sub-frame operable against a fixed knife blade, the rotary knife being rotatably moved by said linkage system which includes a crank member rotatably supported on the second sub-frame.

6. A document printer comprising:

a frame;

a thermal printing element on the frame comprising at least a row of high resistance printing dots;

means to selectively heat individual dots to generate patterns on thermally sensitive paper moved past the thermal printing element;

drive means for driving said thermally sensitive paper along a path past the thermal printing element;

means to cause the paper to engage the thermal printing element so that the printing element is effective to print on the paper;

means to cut off the paper at selected lengths to include predetermined information on the selected length to constitute a ticket;

ticket port means through which the ticket must pass to be accessible and by which the ticket is held until manually removed, supported relative to the frame a distance less than the ticket length from the cut off means, including a deflecting surface against which the ticket must be deflected as the ticket leaves the ticket port means; and guide means directing the paper upwardly in a curve toward said deflecting surface whereby contacting the deflecting surface causes the ticket to reverse curvature into an S form, whereby, if the ticket port means is blocked, the paper will assume a modified S curve position including a storage loop which will resiliently urge the paper out of the ticket port means when the loop is released.

* * * * *